US005556299A

United States Patent [19]

Finke

[11] Patent Number: 5,556,299

[45] Date of Patent: Sep. 17, 1996

[54] SELF-LATCHING CLAMP FOR POWER LINES

[75] Inventor: Ronald J. Finke, Pasadena, Tex.

[73] Assignee: Houston Industries Incorporated, Houston, Tex.

[21] Appl. No.: 409,335

[22] Filed: Mar. 23, 1995

[51] Int. Cl.[6] ..... H01R 13/00

[52] U.S. Cl. ..... 439/479; 439/803

[58] Field of Search ..... 439/477, 478, 439/479, 803

[56] References Cited

U.S. PATENT DOCUMENTS

| | | | |
|---|---|---|---|
| 1,546,839 | 7/1925 | Klingel | 439/814 |
| 2,020,285 | 11/1935 | Becker | 403/384 |
| 2,151,524 | 3/1939 | Pittman | 439/792 |
| 2,206,653 | 7/1940 | Yonkers | 439/803 |
| 2,304,807 | 12/1942 | Donoghue | 439/803 |
| 2,453,761 | 11/1948 | Schoonmaker | 439/477 |
| 2,467,863 | 7/1949 | Hawes | 403/395 |
| 2,508,778 | 5/1950 | Spears | 439/479 |
| 2,811,703 | 10/1957 | Becker | 439/803 |
| 2,864,071 | 12/1958 | Johnson | 439/477 |
| 2,867,787 | 1/1959 | Nilsson | 439/803 |
| 2,958,067 | 10/1960 | Hardy | 439/479 |
| 2,986,053 | 5/1961 | Atman | 81/53.1 |
| 3,036,286 | 5/1962 | Gorc | 439/479 |
| 3,075,166 | 1/1963 | Peek | 439/479 |
| 3,097,037 | 7/1963 | Gainer | 439/777 |
| 3,288,409 | 11/1966 | Bethea | 248/62 |
| 3,325,227 | 6/1967 | Hunter | 403/395 |
| 3,383,739 | 5/1968 | Pitzel | 24/132 R |
| 4,846,725 | 7/1989 | Williams et al. | 439/479 |

*Primary Examiner*—Neil Abrams
*Assistant Examiner*—Barry Matthew L. Standig
*Attorney, Agent, or Firm*—Pravel, Hewitt, Kimball & Krieger

[57] ABSTRACT

A clamp is provided which automatically latches onto a power line when brought into contact with the line for grounding the line or other purposes. The clamp has structural features which prevent inadvertent triggering of the latch mechanism before contact with the power line.

31 Claims, 3 Drawing Sheets

SELF-LATCHING CLAMP FOR POWER LINES

BACKGROUND OF INVENTION

1. Field of Invention

The present invention relates to power line self-latching clamps for grounding and other purposes.

2. Description of the Prior Art

Commonly owned U.S. Pat. No. 4,846,725, of which applicant is an inventor, relates to a self-latching power line clamp. Clamps having structure of the type described in this patent have been generally successful in solving problems in earlier situations when it has been necessary to connect protective grounding equipment to electrical power distribution lines. The grounding equipment was mounted at an end of an elongate insulative rod, known in the industry as a "hot stick," and raised for connection onto the power line.

As an example of problems encountered prior to U.S. Pat. No. 4,846,725, typically the earlier types of grounding equipment had a stirrup or notch which was placed over the power line. The earlier grounding equipment also included a rotatable threaded rod or bolt having an eyelet at a lower end and a gripping jaw at an upper end. The bolt and eyelet were rigidly held in a hollow upper portion of the hot stick as the grounding equipment was raised to the power line and the stirrup placed on the power line. The bolt and eyelet were then released from the hot stick so that a hook at an upper end of the hot stick could engage the eyelet.

Engagement by the hook-mounted hot stick was by nature a relatively loose one. The hot stick could then be rotated by the line crew, moving the bolt inwardly, as long as the hook engagement with the eyelet was maintained. Rotation was continued until the gripping jaw firmly held the power line in place in the stirrup.

So long as the power line was in a substantially horizontal plane and the line crew on the ground below, these earlier apparatus with rotatable threaded rods were generally adequate. There were several situations, however, where problems were present.

For example, there were a number of types of electrical power distribution equipment from which the power lines extended in directions other than horizontally. Breakers and transformers where it was not unusual to have the power line at angles of 45° or more from the horizontal were examples. With power lines in non-horizontal planes, the earlier types of grounding equipment tended to slide down the power line or fall off the line. It was also a difficult task to rotate the threaded rod which was only loosely engaged at its eyelet with the hook on the hot stick.

Another problem situation occurred when the line crew member was working to attach a clamp, even on a generally horizontal line at about the same elevation. Again, manipulation and rotation of the threaded rod was a cumbersome and awkward task.

Apparatus according to commonly owned U.S. Pat. No. 4,846,725 have in a large measure overcome these problems. There have been situations, however, when the release mechanism for the gripping jaw of the type in U.S. Pat. No. 4,846,725 could be triggered by incidental contact with some object or thing before the power line was in position in the gripping jaw of the clamp. When this occurred, the clamp had to be re-armed or re-loaded. This was an inconvenient and at times cumbersome operation. Further, the contact spring of the trigger mechanism was in a relatively exposed position and could at times be damaged during handling, storage, or transportation.

SUMMARY OF INVENTION

Briefly, the present invention provides a new and improved self-latching clamp for power lines. The self-latching clamp of the present invention includes a stirrup for fitting onto the power line and a movable gripping jaw for gripping the power line in the stirrup. A stop member or mechanism in the clamp is provided to normally retain the gripping jaw in an open position, spaced from contact with the power line. A spring is provided in the clamp for urging the gripping jaw into position holding the power line in the stirrup when the stop member is released. A contact is mounted in the stirrup and is engageable by the power line as the clamp is brought into position on the power line. When the contact engages the power line, the stop member is moved out of contact with the gripping jaw. The gripping jaw is then movable due to the force of the spring to a position firmly holding the power line in place within the stirrup on the power line.

The stirrup is preferably formed as a part of a housing body to which the gripping jaw is movably mounted. A protective shoulder is formed on the housing body adjacent the stirrup to protect against inadvertent engagement of the contact and premature triggering of the gripping jaw. The gripping jaw is also provided with upwardly extending fingers which assist in retaining the power line in place within the housing body during movement of the gripping jaw. The fingers also serve as side guards to provide an additional protective feature against premature tripping of the gripping jaw.

DESCRIPTION OF THE PREFERRED EMBODIMENT

Figure 6:
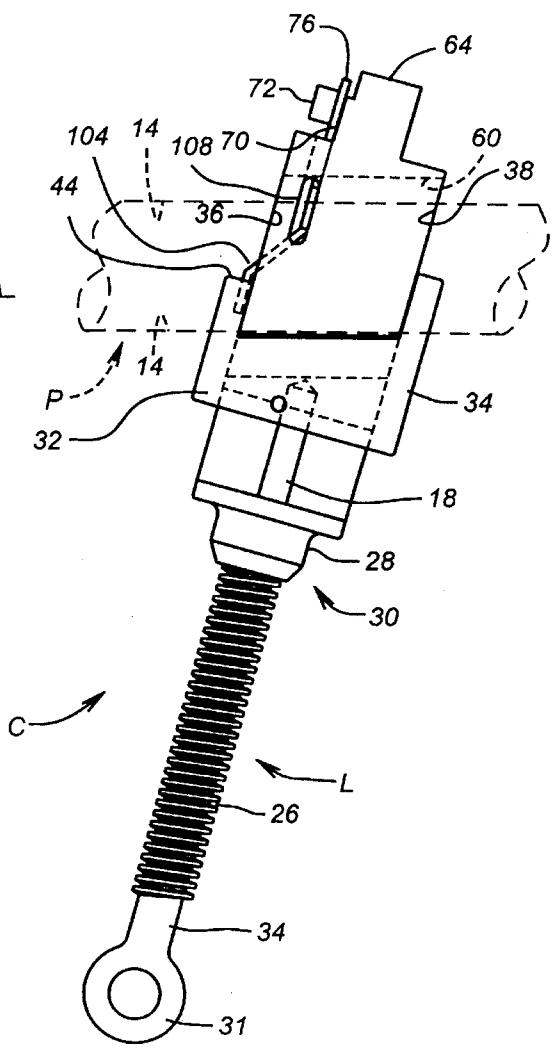
FIG. 6 is a side elevation view of the clamp of FIG. 4.
Figure 5:
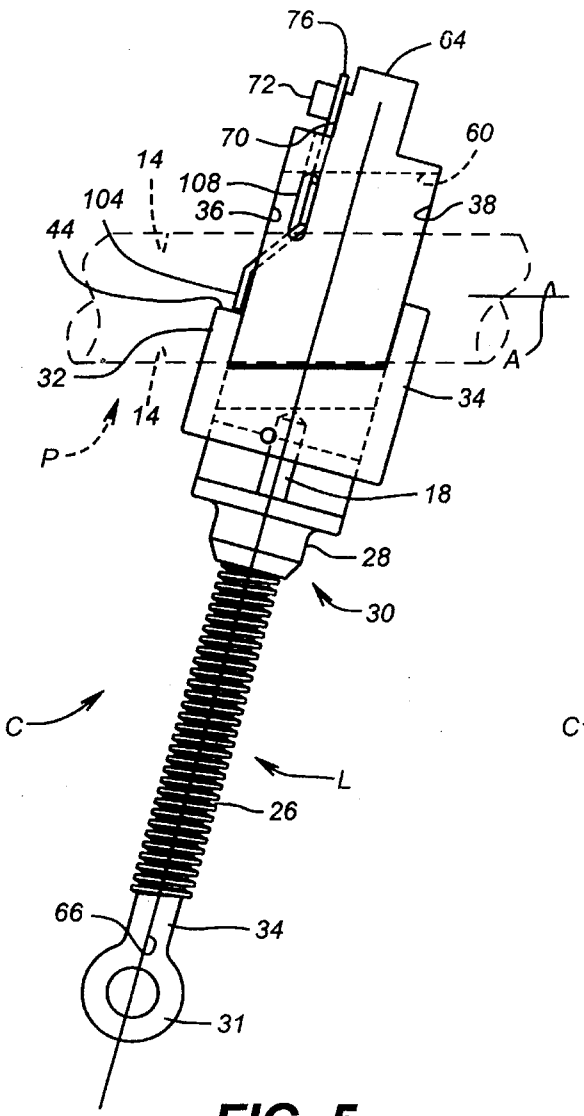
FIG. 5 is a side elevation view of the clamp of FIG. 2.

In the drawings, the letter C designates generally a new and improved self-latching clamp according to the present invention. The clamp C is provided for latching to an electrical powerline P (FIGS. 4–6) during connection of protective grounding equipment to the powerline P. The clamp C includes a stirrup member S formed at an upper end of a housing body H and a gripping jaw G movably mounted at an opposite end of the housing body H from the stirrup S. The gripping jaw G and housing body H are each cast or otherwise suitably formed from a suitable strength aluminum or other material.

The movable gripping jaw G includes a centrally located, upwardly facing cylindrical or arcuate upper contact surface 10 formed on a movable head 12. The contact surface 10 conforms generally to an outer surface 14 of the powerline P. The contact surface 10 of the movable head member 12 is also preferably knurled or otherwise roughened to insure firm gripping action on the powerline P.

Figure 1:
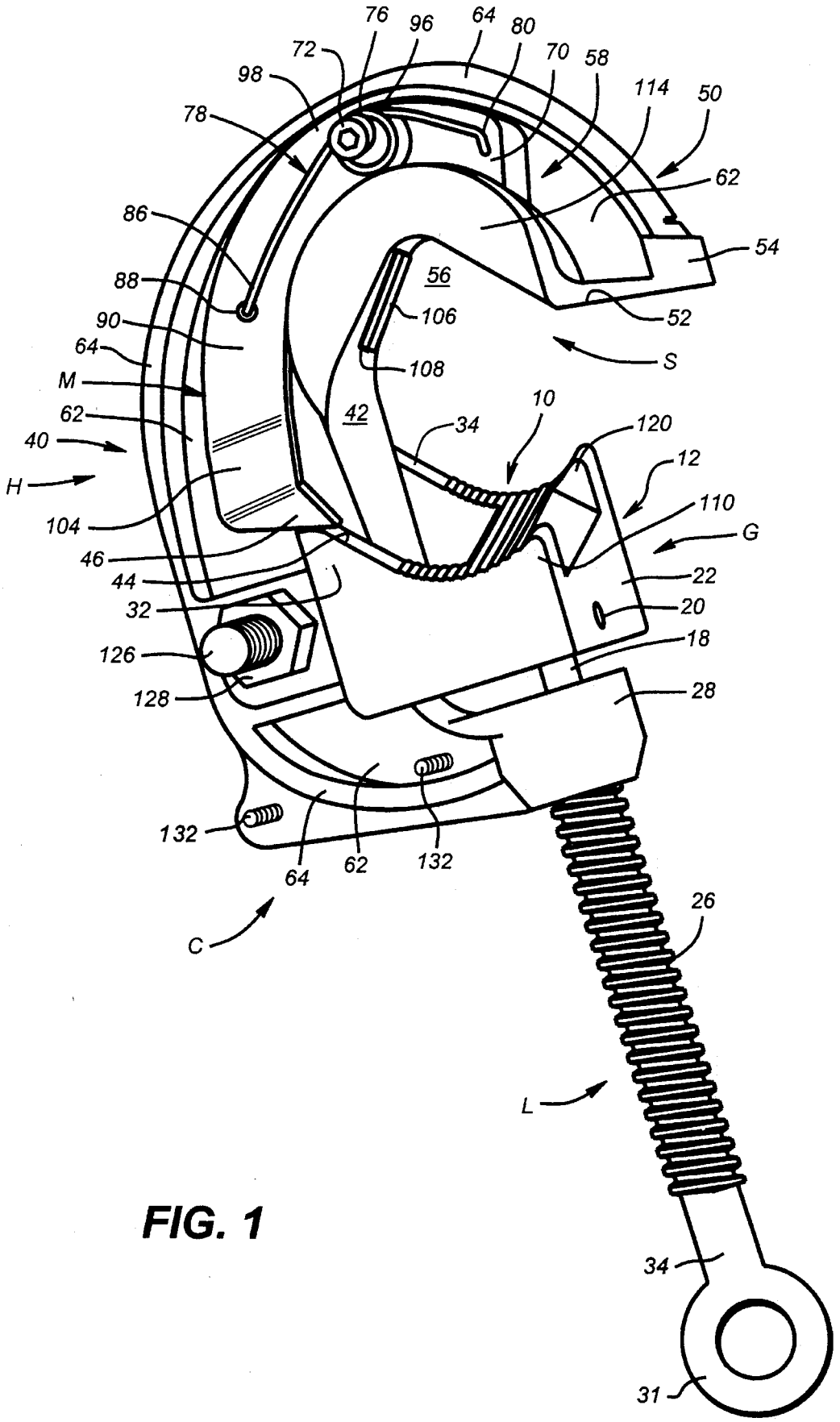
FIG. 1 is an isometric view of a self-latching clamp for power lines according to the present invention.
Figure 3:
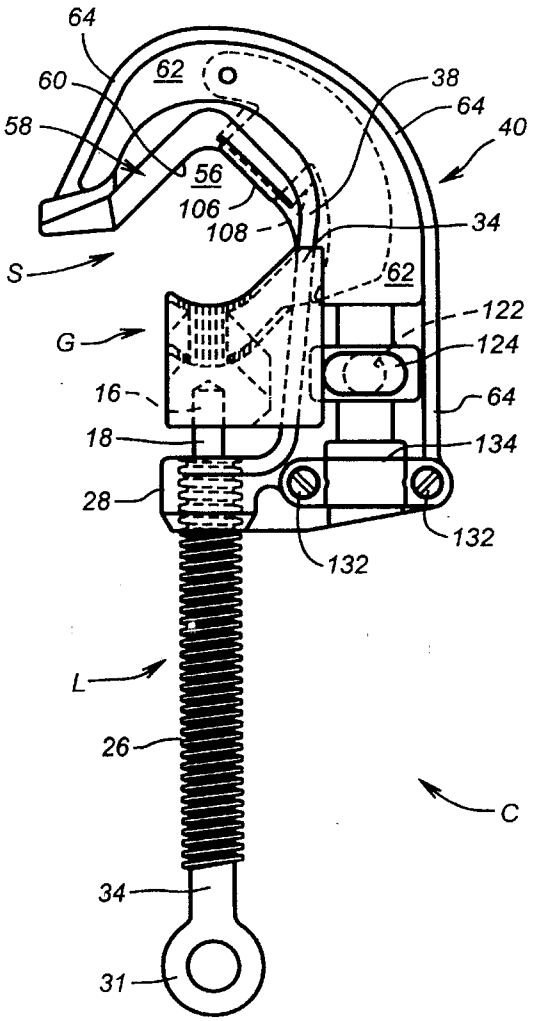
FIGS. 2 and 3 are front and rear elevational views, respectively, of the clamp of FIG. 1.

The head member 12 is mounted to an upper end 16 (FIGS. 2&3) of a connector rod 18 by a suitable connecting mechanism. A typical connecting mechanism, for example, is a set screw or other suitable fastener inserted through an opening 20 (FIGS. 1,5&6) in a front face 22 of the head member 12. The connector rod 18 is contained within an internal passage 24 (FIG. 4) of a locking nut or eye screw L. As was the case in U.S. Pat. No. 4,846,725, which is incorporated herein by reference for all purposes, the connector rod 18 connects the gripping jaw G to a compressible, releasable spring R mounted in the interior passage 24 of the locking bolt L.

The locking bolt L has a threaded external surface 26 which is received in and mates with a corresponding threaded internal passage of a sleeve 28 formed in a lower end 30 of the housing body H. A connector eyelet 31 is formed at a lower end 34 of the locking bolt L. for the purposes of receiving a hook at an upper end of a connector stick or "hot stick" being manipulated by a powerline crew member.

The head member 12 of the gripping jaw G has upwardly extending shoulders 32 and 34 formed extending rearwardly from the contact surface 10. The shoulders 32 and 34 are adapted to move past sidewalls 36 and 38, respectively, of a central body portion 40 adjacent a rear wall 42 of the housing body H. The shoulder 32 has a contact or camming surface 44 formed at an upper or rear end thereof which is adapted to be engaged by a contact lug or detent 46 of a stop mechanism M.

The stirrup S is formed at an upper or opposite end 50 of the housing body H from the gripping jaw G. The stirrup S has a guide surface 52 formed beneath a nose or contact member 54 which is adapted to contact the outer surface 14 of the powerline P and slide along same, moving the powerline P into a trough or channel 56 below a channel member or sleeve 58.

A downwardly facing, cylindrical or arcuate contact surface 60 is formed in the interior of the channel 58 and is adapted to rest on the outer surface 14 of the powerline P. The contact surface 60 of sleeve member 58 extends laterally a suitable width (FIGS. 5&6) to insure adequate gripping with the outer surface 14 of the powerline P. The contact surface 60 of the stirrup S may also, if desired, be knurled or otherwise roughened to increase gripping action on the external surface 14 of the powerline P.

The housing body H has a central stiffener beam 62 formed extending rearwardly from the central body portion 40. The stiffener beam 62 also extends upwardly above the channel member 58 to the contact member 54. The stiffener beam 62 further extends rearwardly and downwardly from the central body portion 40 adjacent the sleeve 28. An outer protective rim or flange 64 is formed extending over the length of the extent of the stiffener beam 62.

As was the case in prior U.S. Pat. No. 4,846,725, the contact surface 10 of the gripping jaw G and the contact surface 60 of the stirrup S are adapted to extend substantially coaxially with an longitudinal axis A (FIG. 5) of the powerline P. The locking bolt S is formed extending at a longitudinal axis, indicated by an arrow 66 (FIG. 5), which is transverse to the longitudinal axis A of the powerline P, preferably at an acute angle. Any suitable acute angle may be used, such as those in the ranges described in U.S. Pat. No. 4,846,725, depending upon operating conditions envisioned for the clamp C. In certain circumstances, the angle of intersection of the axis of the locking bolt L and the powerline P may even be substantially perpendicular, if desired.

A raised portion 70 is formed on the stiffener beam 62 above the channel member 58 on the side of the housing body H to which the stop mechanism M is mounted. A connector spool or pin 72 is formed extending outwardly from the raised portion 70 above the stirrup S. The spool 72 is adapted to receive a central loop or turn 76 of a coil spring 78 which is fitted thereover. A forward end 80 of the coil spring 78 is in contact at an end 82 with the raised portion 70 of stiffener beam 62 along its surface.

The coil spring 78 extends rearwardly from the contact end 82 to the central loop or turn 76 about the spool 72, and therefrom rearwardly to a rear portion 86. The rear portion 86 of spring 78 is adapted to be mounted in an opening 88 formed in a central portion 90 of the stop mechanism M.

An inner end 92 of the rear portion 86 of the coil spring 78 extends through the opening 88 in the stop mechanism M. The coil spring 78 exerts a compressive force on the stop mechanism M urging the detent 46 inwardly against the stiffener beam 62. Accordingly, when the gripping jaw G is moved downwardly below and past the detent 46, the contact surface 44 of gripping jaw G is engaged. Gripping jaw G is thus again armed and locked against upward movement by the releasable spring R. The inner end 92 of spring 78 slidably moves in a slot 94 formed in the raised portion 70 of housing body H above the stirrup S.

The stop mechanism M is preferably formed of a resilient material, such as stainless or other steel. An opening 96 (FIG. 1) is formed in an upper portion 98 of the stop mechanism M and is fitted over the pin 72. The stop mechanism M is thus pivotally mounted at the upper portion 98 with the housing body H above the stirrup S. The stop mechanism M extends from the upper portion downwardly past the central portion 90 to a lower portion 104 on which the contact lug or detent 46 is formed. The lower portion 104 of the stop mechanism M is preferably spaced from and formed extending outwardly (FIGS. 5&6) with respect to the upper portion 98 and central portion 90 in order to both engage the contact surface 44 of shoulder 32 and have clearance to move past the side wall 36 of the housing body H.

The stop mechanism M also includes a trigger or actuator in the form of a contact button or blade 106. The trigger 106 is formed extending inwardly from the central portion 90 of the stop mechanism M through channel 58, passing through an opening 108 formed in the contact surface 60 of the stirrup S. It is to be noted that the trigger 106 and opening 108 are formed in the stirrup S at an internal position of the stirrup S. Being thus located, the contact 106 is protected from inadvertent contact or damage during handling, storage or transportation of the clamp C.

Figure 2:
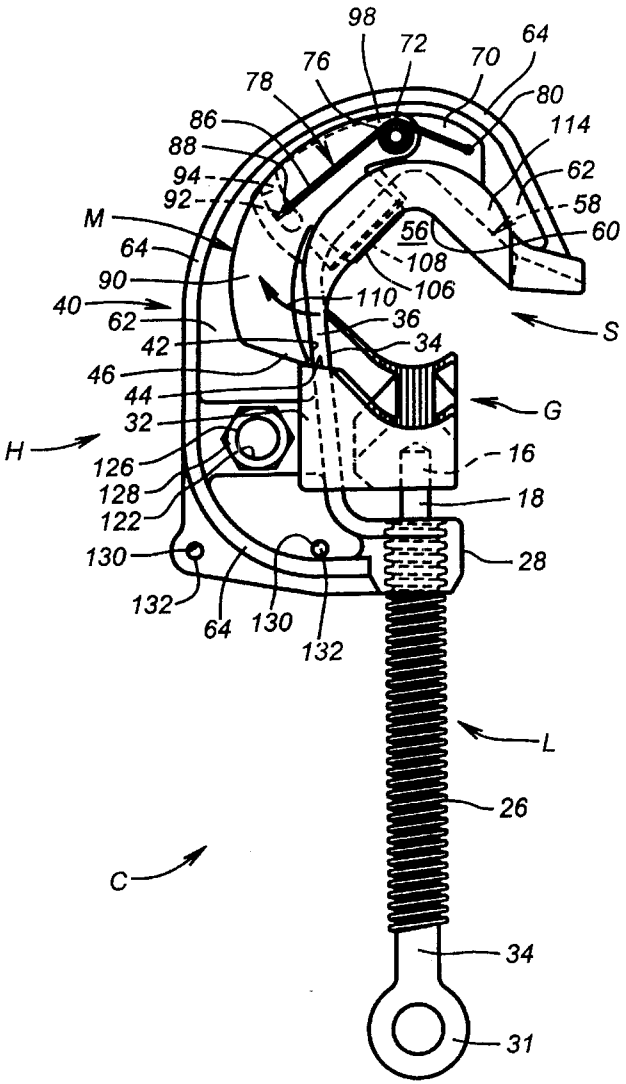
Figure 4:
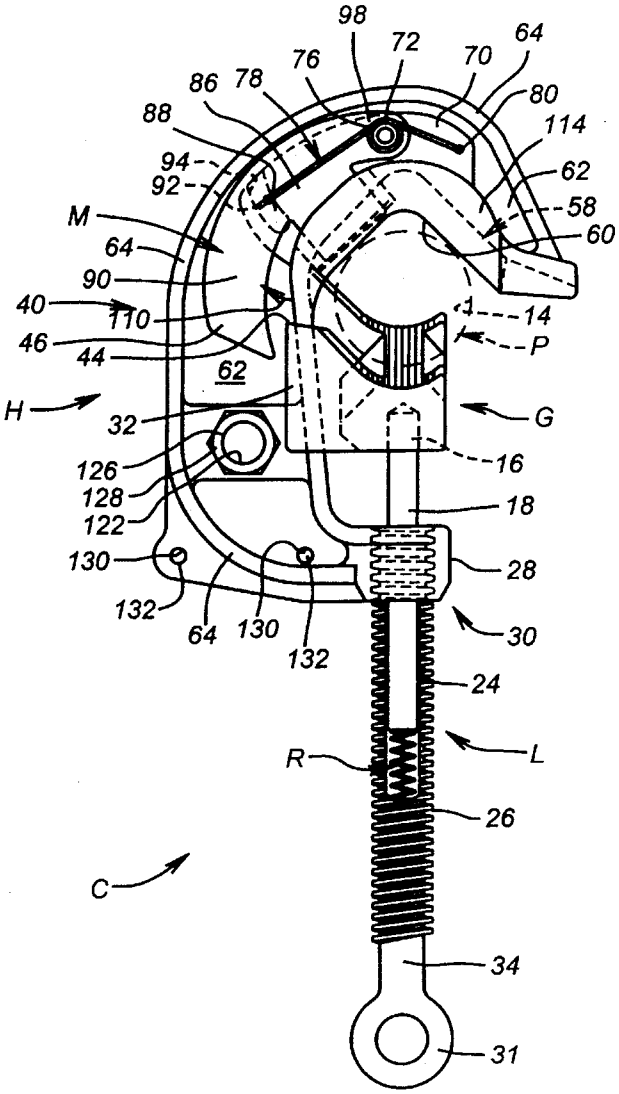
FIG. 4 is a front elevation view like that of FIG. 2, and showing the clamp engaging a power line.

The contact 106 is, however, adapted to be contacted by the outer surface 14 of the powerline P, causing the stop mechanism M to pivot rearwardly and upwardly about the sleeve 72 as indicated by an arrow 110 (FIGS. 2&4). This pivotal movement of stop mechanism M moves the detent 46 (FIG. 4) away from contact with the contact surface 44 on the gripping jaw G. This removes the restraining action of the stop mechanism M and releases the force exerted on the gripping jaw G by the releasable spring R within the locking bolt L. When this occurs, the spring R of the locking bolt L automatically moves the gripping jaw G upwardly (FIGS. 4&6), forcing the powerline P firmly into position within the stirrup S.

A protective shoulder 114 is formed on the channel member 58 of housing body H adjacent the opening 108. The shoulder 114 functions to protect both the contact 106, the spring 78 and the stop mechanism M from inadvertent contact. This is done as a further protective feature against premature release of the gripping jaw G during handling and movement of the clamp C once the spring R is compressed.

The gripping jaw G is provided with a pair of upwardly extending fingers or rails 118 and 120. The fingers 118 and 120 are formed on side portions of the gripping jaw G across the contact surface 10 from the shoulders 32 and 34, respectively. The fingers 118 and 120 function as retainers, resisting any tendency of the powerline P to roll or slide off of contact surface 60 and out of the space 56 between the gripping jaw G and stirrup S. For smaller diameter powerlines, the fingers 118 and 120 can effectively block such outward movement of the powerline P.

The housing body H is also provided, as is conventional, with a socket or opening 122 (FIGS. 2 & 4) for passage of a conventional connector eyelet 124 having a threaded end 126 (FIG. 1) received in a nut 128. As is also conventional, suitable connector openings 130 (FIGS. 2,3, and 4) are formed in the housing body H for receipt of connector or attachment screws 132 to affix a grounding conductor cover tube or strap 134.

In the operation of the present invention the clamp C is armed at a work site by moving the gripping jaw G downwardly in the housing body H until spring 78 moves the detent 46 of stop mechanism M into engagement (FIG. 2) with surface 44 of shoulder 32. As this movement occurs, the releasable spring R in the locking nut L is compressed. The clamp C may then be moved by means of a manipulating arm or hot stick into a position where the powerline P fits into the stirrup S.

The outer surface 14 of the powerline P, as it enters the stirrup S, contacts the trigger 106. The stop mechanism M is pivoted as indicated by arrow 110 as a result of such contact, moving the detent 46 out of engagement with the gripping jaw G. The restraining action of stop mechanism M on releasable spring R is thus removed, and the gripping jaw G rapidly moves toward the stirrup S, firmly engaging the powerline P between the contact surfaces 10 and 60. The fingers 118 and 120 assist in retaining the powerline P in place on the gripping jaw G during such movement. The locking nut L can then be rotated and moved upwardly, as is conventional, by the hot stick until the clamp C is firmly locked onto the powerline P.

To unlock the clamp C, the locking nut L is rotated in a reverse direction, moving the gripping jaw G downwardly until the spring 78 moves detent 46 of stop mechanism M into restraining engagement with gripping jaw G. The clamp C is thus again armed again for subsequent use.

Having described the invention above, various modifications of the techniques, procedures, material and equipment will be apparent to those in the art. It is intended that all such variations within the scope and spirit of the appended claims be embraced thereby.

I claim:

1. A clamp for connecting onto a power line, comprising:

(a) stirrup means for fitting onto the power line;

(b) movable gripping jaw means for gripping the power line in said stirrup means;

(c) stop means for retaining said gripping jaw means in an open position, spaced from contact with the powerline;

(d) spring means for urging said gripping jaw means into position holding the power line in said stirrup means when said stop means is released; and (e) contact means mounted in said stirrup means and engageable by the power line for releasing said stop means to allow said spring means to urge said gripping jaw means into position holding the power line in said stirrup means.

2. The clamp of claim 1, wherein said stirrup means includes:

a contact surface adapted to receive and fit against a surface of the power line.

3. The clamp of claim 2, wherein:

said contact means is movably mounted extending from said contact surface of said stirrup means for engaging the power line.

4. The clamp of claim 3, further including:

a housing body having said stirrup means mounted therewith.

5. The clamp of claim 4, further including:

a protective shoulder formed on said housing body adjacent said stirrup means for preventing inadvertent engagement of said contact means.

6. The clamp of claim 1, wherein:

said contact means is pivotally mounted with respect to said stirrup means.

7. The clamp of claim 1, wherein:

said stop means is pivotally mounted with respect to said stirrup means.

8. The clamp of claim 7, wherein said stop means includes:

an upper portion pivotally mounted with said stirrup means; and a lower portion extending from said upper portion and having a contact detent for engaging said gripping jaw means for retaining said gripping jaw means in the open position.

9. The clamp of claim 8, further including:

bias means for urging said contact detent into engagement with said gripping jaw means.

10. The clamp of claim 9, wherein:

said contact means comprises means for moving said stop means contact detent out of engagement with said gripping jaw means when engaged by the power line.

11. The clamp of claim 1, wherein:

said contact means and said stop means are integrally formed with each other.

12. The apparatus of claim 1, wherein:

said gripping jaw means includes upwardly extending fingers formed on side portions thereof spaced from each other to retain the power line in said stirrup means.

13. In a clamp for connection with a power line having a stirrup fitting onto the power line and a movable gripping jaw for gripping the power line in the stirrup, the improvement comprising:

(a) stop means for retaining said gripping jaw means in an open position, spaced from contact with the powerline;

(b) spring means for urging said gripping jaw means into position holding the power line in said stirrup means when said stop means is released; and (c) contact means mounted in said stirrup means and engageable by the power line for releasing said stop means to allow said spring means to urge said gripping jaw means into position holding the power line in said stirrup means.

14. The clamp of claim 13, wherein said stirrup means includes:

a contact surface adapted to receive and fit against a surface of the power line.

15. The clamp of claim 14, wherein:

said contact means is movably mounted extending from said contact surface of said stirrup means for engaging the power line.

16. The clamp of claim 15, further including:

a housing body having said stirrup means mounted therewith.

17. The clamp of claim 16, further including:

a protective shoulder formed on said housing body adjacent said stirrup means for preventing inadvertent engagement of said contact means.

18. The clamp of claim 13, wherein:

said contact means is pivotally mounted with respect to said stirrup means.

19. The clamp of claim 18, wherein:

said stop means is pivotally mounted with respect to said stirrup means.

20. The clamp of claim 19 wherein said stop means includes:

upper portion pivotally mounted with said stirrup means;

a lower portion extending from said upper portion and having a contact detent for engaging said gripping jaw means for retaining said gripping jaw means in the open position.

21. The clamp of claim 20, further including:

bias means for urging said contact detent into engagement with said gripping jaw means.

22. The clamp of claim 21, wherein:

said contact means comprises means for moving said stop means contact out of engagement with said gripping jaw means when engaged by the power line.

23. The clamp of claim 13, wherein:

said contact means and said stop means are integrally formed with each other.

24. The apparatus of claim 13, wherein:

said gripping jaw means includes upwardly extending fingers formed on side portions thereof spaced from each other to retain the power line in said stirrup means.

25. A clamp for connecting onto a power line, comprising:

(a) stirrup means for fitting onto the powerline;

(b) movable jaw means for gripping the powerline in said stirrup means;

(c) a housing body having said stirrup means mounted at a first end thereof and said movable jaw means mounted at a second end thereof;

(d) said movable jaw means having an open position, spaced from contact with the powerline, allowing passage of the powerline into position fitting against the powerline in said stirrup means;

(e) means for automatically releasing said movable jaw means from the open position for movement to engage the powerline in said stirrup means; and (f) said movable jaw means having upwardly extending fingers formed thereon for retaining the powerline within said housing body and said stirrup means.

26. The clamp of claim 25, further including:

spring means for urging said movable jaw means into position holding the powerline in said stirrup means when said movable jaw means is released.

27. The clamp of claim 26, wherein said means for automatically releasing comprises:

means for automatically releasing said movable jaw means from the open position for movement to engage the powerline.

28. The clamp of claim 27, wherein:

said contact means is mounted in said stirrup means.

29. The clamp of claim 28, further including:

a housing body having said stirrup means mounted therewith.

30. The clamp of claim 25, further including:

said movable jaw means having a gripping surface formed thereon for contact with an outer surface of the powerline.

31. The clamp of claim 25, wherein:

said fingers on said movable jaw means are formed on side portions thereof and spaced from each other.

* * * * *